United States Patent [19]

Heinlein

[11] 4,068,327

[45] Jan. 17, 1978

[54] SWIMMING POOL SURFACE DEBRIS SKIMMER AND METHOD

[76] Inventor: Joseph Heinlein, 15128 Chestnut Lane, Oak Forest, Ill. 60452

[21] Appl. No.: 728,296

[22] Filed: Sept. 30, 1976

[51] Int. Cl.[2] ..... E04H 3/20

[52] U.S. Cl. ..... 4/172.15; 4/172.17; 210/169

[58] Field of Search ..... 4/172.15, 172.16, 172.17, 4/172.18; 15/246.5; 137/544; 210/169, 540

[56] References Cited

U.S. PATENT DOCUMENTS

| | | | |
|---|---|---|---|
| 3,152,076 | 10/1964 | Kreutzer | 4/172.17 |
| 3,244,284 | 4/1966 | Shaffer | 4/172.17 |
| 3,625,364 | 12/1971 | La Chance | 210/169 |

*Primary Examiner*—Richard E. Aegerter
*Assistant Examiner*—Richard R. Stearns
*Attorney, Agent, or Firm*—Hill, Gross, Simpson, Van Santen, Steadman, Chiara & Simpson

[57] ABSTRACT

Surface debris on a swimming pool is floated toward and into a skimmer pocket and directed toward an overflow. A skimmer bar projecting generally obliquely toward the direction from which normal circulation of water in the pool takes place defines with the adjacent pool side the pocket for receiving and directing the debris. The skimmer bar has a bracket for mounting the bar removably to project from the side of the pool adjacent to the overflow outlet.

10 Claims, 4 Drawing Figures

11
43
42
41
38
24
28
20
32
35
39
37
45
19
30
31
L
22
27
25
10

44
43
42
24
41
34
35
38
37
39
40
33
32
29
31
25
23
27
10
19
22
45
28
21

SWIMMING POOL SURFACE DEBRIS SKIMMER AND METHOD

This invention relates to new and improved means for removing surface debris from swimming pools.

Various expedients have hertofore been employed for removal of floating debris from swimming pools. Most cmmon of such expedients is a skimmer net which is manually manipulated and depends entirely upon the skill and thoroughness of the user and is generally used merely to remove the more obvious, larger debris, leaving smaller floating particles on the surface. Another expedient comprises a manually operated sweep which may or may not be floatable, and may require two persons to manipulate. All of these expedients are time consuming and less than thorough in removing floating debris.

An important object of the present invention is to provide a new and improved swimming pool surface debris skimmer which will overcome the disadvantages, deficiencies, inefficiencies, shortcomings and problems inherent in the prior art.

Another object of the invention is to provide a new and improved swimming pool surface debris skimmer and method which will function without personal attention, utilizing normal water circulation action in the swimming pool.

A further object of the invention is to provide a new and improved swimming pool surface debris skimmer which can be easily installed and removed as desired.

Still another object of the invention is to provide a new and improved swimming pool debris skimmer which is readily adaptable for various swimming pool designs and structures and which is simple in construction, is readily adjustable to meet various conditions, and which is rugged and reliable in operation.

According to features of the invention a swimming pool surface debris skimmer comprises a skimmer bar, and means for mounting the bar to project from the side of a swimming pool to define with the adjacent side wall of the pool a debris-receiving pocket having a wide mouth which opens toward inflowing surface water circulating toward the pocket to direct the debris toward an overflow drain in the side of the pool.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

Figure 2:
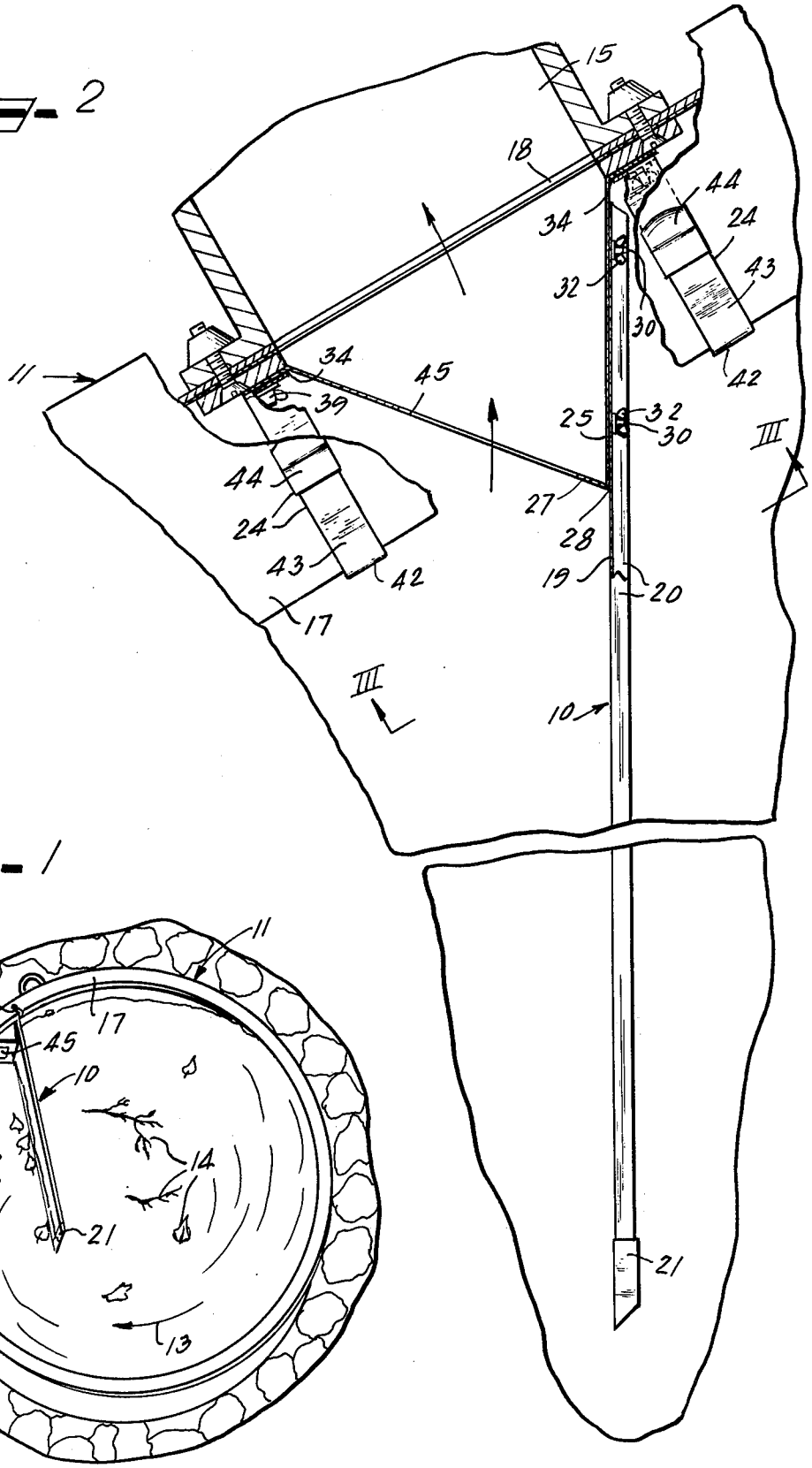
FIG. 2 is an enlarged fragmental top plan view, partially in section, showing how the surface debris skimmer is mounted in operative relation to a swimming pool.
Figure 1:
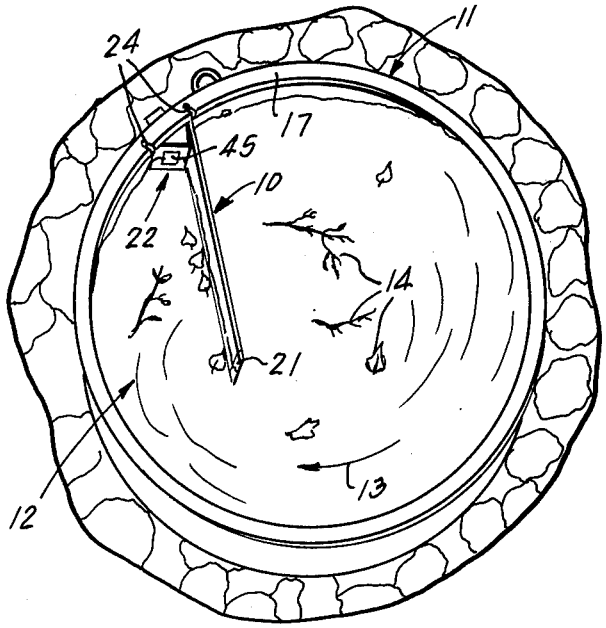
FIG. 1 is a top isometric view of a representative swimming pool equipped with a surface debris skimmer according to the present invention.

A swimming pool surface debris skimmer according to the present invention, comprises a skimmer bar 10 which is adapted to be mounted, substantially as shown in FIGS. 1 and 2, to project from the side of a swimming pool 11 to define with the adjacent side wall of the pool a debris-receiving pocket 12 having a wide mouth which opens toward inflowing surface water which circulates as indicated by the arrow 13 in FIG. 1 toward the pocket 12 to direct debris, representatively identified as 14, toward an overflow drain 15 (FIG. 2) in the pool side wall. In some pools the overflow drain may comprise a trough under a pool rim 17, but in other types of pools the drain 15 may be in the form of a duct for receiving overflow water and debris through a drain port 18 in the pool side wall. Although the pool 10 has been shown as of round configuration, it will be understood that the skimmer will function with equal facility in association with pools of other geometric outlines.

Figure 3:
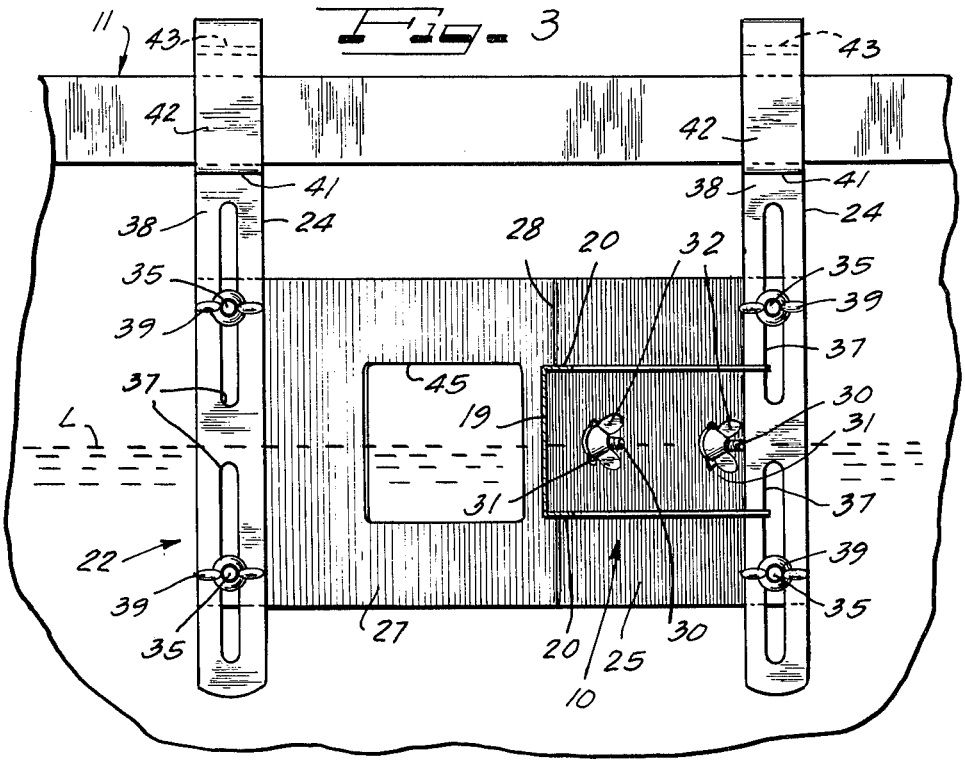
FIG. 3 is a fragmentary sectional elevational view taken substantially along the line III—III of FIG. 2.
Figure 4:
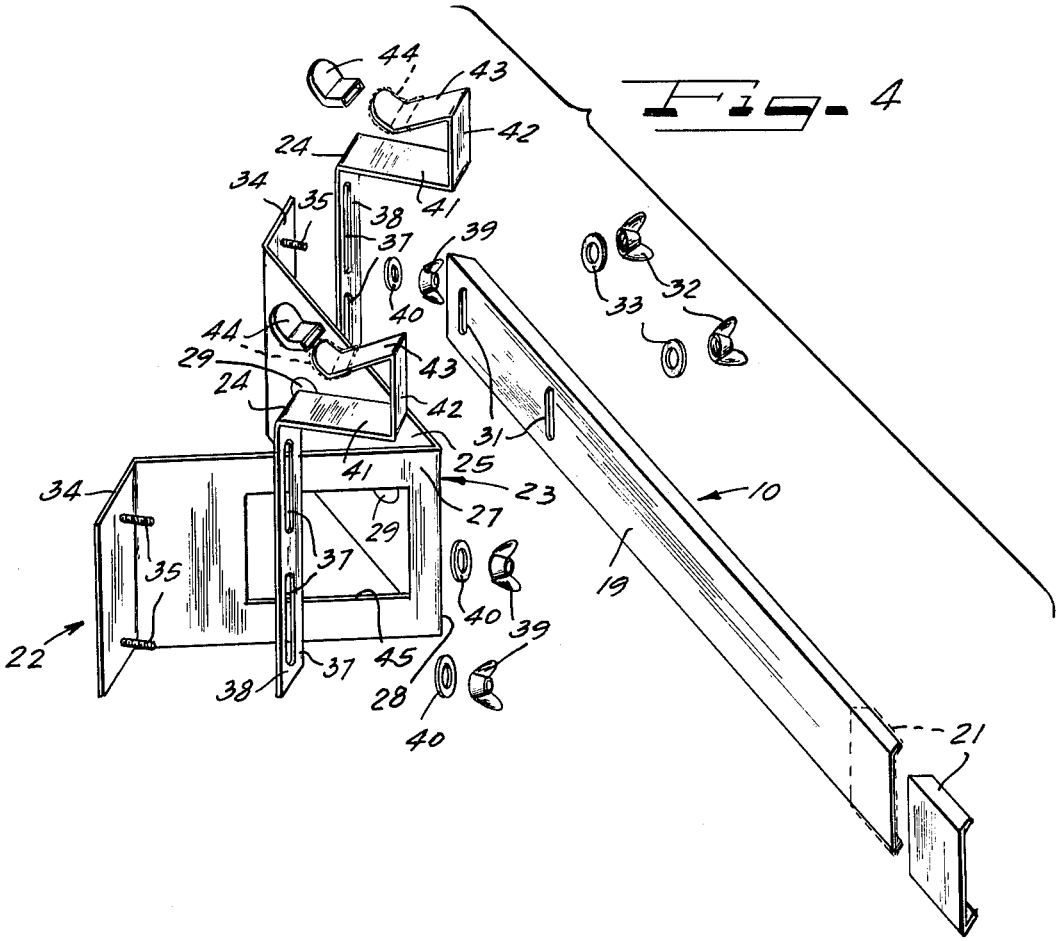
FIG. 4 is an exploded assembly view of the skimmer bar and mounting bracket structure.

In a preferred construction, the skimmer bar 10 is made from a suitable lighweight non-rusting material. Although it may be constructed as a plastic extrusion, it may be economically fashioned from aluminum strip material such as 20 gauge aluminum with a body web 19 (FIGS. 2 and 3) adapted to lie vertically in service, and provided with upper and lower substantially coextensive rearwardly turned stiffening and reinforcing flanges 20, leaving the front face of the bar unobstructed. By way of example, the body width of the bar 10 may be from 2 to 3 inches (5 to 7 ½ cm) and of a length of about 45 to 50 inches (1 to 1 ½ m). At its distal tip, the bar 10 is desirably smoothly finished and for this purpose may be provided with a soft plastic tip protector 21 (FIGS. 2 and 4) which may be applied by dipping in fused plastic, or as may be more convenient comprise a molded piece which is assembled by slipping it onto the end of the bar.

Means for mounting the bar 10 in operative surface debris skimming relation on the side of the pool 11, comprise a bracket structure 22. In a preferred form the bracket structure includes a body 23 and a pair of mounting clips 24. In a preferred form, the bracket body 23 is of substantially V-shape in plan and formed up from suitable non-rusting lightweight material which may comprise suitable rigid plastic, but may economically comprise 20 gauge aluminum strip material formed to provide generally divergently related vertically oriented member panels 25 and 27 joined along a vertical reinforcing bend juncture 28 and diverging to a distal end width sufficient to span a drain area of a swimming pool. The panel 25 is adapted for mounting of the proximal end portion of the bar 10 thereto and for this purpose is desirably equipped with a pair of horizontally spaced short bolts which may be permanently affixed to present studs 30 projecting from the outer face of the panel 25 for reception through complementary mounting holes 31 in the form of vertically elongated spaced slots in the proximal end portion of the body web 19 of the bar 10. Fastener means in the form of wing nuts 32 secured on the studs 30 desirably with intervening washers 33 fasten the bar 10 to the panel 25 and thus to the bracket body 23. The vertical slots enable a reasonable range of vertical adjustment of the bar 10 relative to the bracket body 23.

Means for attaching the clips 24 to the bracket body 23 comprise respective oppositely exending attachment flanges 34 on the distal ends of the panels 25 and 27. Each of the flanges 34 is provided with a pair of vertically spaced stud bolts 35 adapted to be received through vertically spaced holes 37 desirably in the form of vertically elongated slots in vertical legs 38 on the clips 24. Fastening of the clips in suitable vertically adjusted position is effected by means of wing nuts 39 fastened onto the studs 35 desirably with intervening washers 40. Each of the brackets 24 is desirably constructed from any suitable material such as 8 gauge aluminum strip. At the upper end of the leg 38 each of the clips 24 has a gripping jaw structure including a horizontal lower flange 41 and upstanding connecting flange 42 and a return bent gripping finger flange 43 overlying the flange 41 in spaced relation and extending obliquely downwardly to a generally upturned oblique tip which is preferably equipped with a soft protective cover 44. In a desirable form the tip protectors 44 may be of preformed plastic slipped into position on the tips of the gripping fingers 43.

After the bar 10 has been assembled with the mounting bracket assembly 22, the bar is adapted to be mounted on the side of the pool 11 by engaging the clip jaws in gripping relation onto the inward overhang of the swimming pool rim 17. By suitable vertical adjustment of the bracket body 23 on the clips 24 and if necessary vertical adjustment of the bar 19 relative to the supporting panel 25 of the bracket, the optimum skimming position of the bar 10 relative to the water level L in the pool is attainable. In order to accommodate reasonable flucatuations in water level, the bar 10 may be partially immersed such as about ½ to 2/3 the width of the bar body 19, and with sufficient of the elongate vertical width of the bar projecting above the water level L to reasonably avoid debris carrying surface water sweeping over the bar when the water is riled by wind action or other activity in the pool. By virtue of the oblique angular disposition of the bar supporting panel 25 of the bracket 22 to a vertical plane across the mounting flanges 34, the bar 10 is supported in a similarly oblique relation to the side of the pool 11 on which the bar is mounted, whereby to define the relatively wide mouth pocket 12 with the adjacent side wall portion of the pool.

By having the bracket body 23 detachably mounted on the clips 24, and configured to be flipped over the oblique angular disposition of the bar 10 can be readily altered to accommodate either a clockwise or counterclockwise surface water circulation. In FIGS. 1 and 2 a clockwise circulation is accommodated. By reversing the bracket body 23, a counterclockwise circulation can be accommodated with equal efficiency.

In either the clockwise circulation accommodating position, or the counterclockwise circulation accommmodating position of the bar 10, the panel 27 of the bracket body 23 will face the inner end of the debris trapping pocket 12 so that the debris laden surface water will pass through a discharge opening 45 of substantial vertical and horiziontal dimensions in the panel 27 and escape into the overflow 15, substantially as shown by directional arrows in FIG. 2. By virtue of the clip-on mounting of skimmer device, it is adapted to be easily mounted in skimming position when the swimming pool 11 is not in use. During use of the pool, the bar 10 can be readily removed from the pool and stored in an out of the way position until it is again desired to use the same. While the skimmer device is in service, no special attention need be given to it since it functions automatically to capture and divert the surface debris to the overflow as long as circulation toward the skimmer pocket is maintained.

It will be understood that variations and modifications may be effected without departing from the spirit and scope of the novel concepts of this invention.

I claim as our invention:

1. A skimming device for removing surface debris from a swimming pool filled with water, the swimming pool having a side wall provided with an overflow drain and the water in the pool circulating in one direction, the device comprising:

an elongate skimmer bar;

means for attaching one end of the bar to the pool side wall adjacent to the overflow drain and with the bar projecting from the pool side wall divergently relative to the pool side wall and partially immersed along the length of the bar in the surface of the water to define with the adjacent area of the side wall of the pool a debris-receiving pocket having a wide mouth directed toward the circulating water to direct debris in the inflowing circulating water toward the overflow drain;

a bracket member attached to and extending in supporting relation from said one end of the bar to project across the inner end portion of said pocket to said pool side wall;

and means for attaching said bracket member to the pool side wall at a point on said wall spaced from said bar attaching means;

said bracket member being shaped to permit surface water which flows into the pocket to escape past the bracket member to the overflow drain.

2. A skimmer according to claim 1, wherein said bar is formed from lightweight material selected from aluminum or extruded plastic and is of channel-shaped cross-section and has a protectively finished distal end tip.

3. A skimmer according to claim 1, wherein said means for attaching the end of the bar to the pool side wall and the means for attaching said bracket member to the pool side wall comprise detachably mounted clips.

4. A skimmer according to claim 1, wherein said bracket member comprises one arm of a bracket structure of generally V-shape in plan having a second arm and said second arm comprising the means for attaching the bar to the pool side wall and including means thereon for effecting attachment to the pool side wall.

5. A skimmer according to claim 4, wherein said arms comprise plates joined integrally along a juncture bend, said bracket member having an opening therethrough for passage of circulating surface water in said pocket toward the overflow drain.

6. A skimming device for removing surface debris from a swimming pool filled with water, the swimming pool having a side wall provided with an overflow drain and the water in the pool circulating in one direction, the device comprising:

an elongate bar of a vertical width ample to permit partial submersion of the bar in a horizontal position in the surface water in the swimming pool;

a mounting bracket body of generally V-shape in plan having vertically oriented horizontally extending divergently related portions;

said portions having distal end means;

attachment clip means vertically adjustably attached to said distal end means and having upper gripping jaws for releasably grippng structure at the upper end of the swimming pool wall;

and means attaching an end portion of the bar to one of said diverging portions whereby to support the bar in a generally diverging relation to the pool wall adjacent to the overflow drain for directing surface debris circulating into a pocket defined between the bar and the pool wall toward the overflow drain.

7. A skimmer according to claim 6, wherein said clip means are reversibly mounted on said bracket body and said bracket body is configured to be flipped over for selectively reversing the direction of divergence of the bar relative to the swimming pool wall so as to accommodate either clockwise or counter-clockwise circulation of surface water into the debris-receiving pocket for direction of the surface debris toward the overflow drain.

8. A skimming device for removing surface debris from a swimming pool filled with water, the swimming pool having a side wall provided with an overflow drain and the water in the pool circulating in one direction, the device comprising:

an elongate skimmer bar;

a supporting bracket on one end of the skimmer bar for supporting the skimmer bar in substantially diagonally divergent relation to the pool side whereby to define with the pool side a surface water debris-receiving pocket having a wide mouth directed toward the circulating water to direct debris laden surface water to the overflow drain;

said bracket being configured to be flipped over to a second supporting position;

and means for attaching the bracket to the pool wall in either position of the bracket so that the bar can be selectively oriented in opposite diagonally diverging relation to the pool wall by flipping over said bracket whereby to accommodate either clockwise or counterclockwise circulation of the surface water into the debris laden surface water receiving pocket.

9. A skimmer according to claim 8, wherein said bracket comprises divergently related fixedly connected arms oriented in generally V-shape in plan, said bar attached to and projecting substantially in the plane of one of said arms; and said means for attaching to the pool side wall comprising clips detachably attached to distal ends of said arms, and being detachable and replaceable to enable flipping over of said bracket for reversing the diagonal relationship of the bar to the pool side.

10. A skimmer according to claim 8, wherein said bracket comprises a one piece structure having divergent arms in generally V-shape orientation in plan, each of said arms having a lateral attachment flange at its distal end, a respective attachment clip for each of said flanges, means for detachably securing said clips to said flanges and permitting flipping over of the bracket by detaching and reversing the clips with respect to said flanges, and means attaching an end portion of the bar to one of said arms to project from the arm in substantially the plane of the arm to which the bar is attached and whereby the arm is supported in substantially diagonally skimmer pocket forming relation to the wall of the pool and whereby the diagonal orientation of the bar to the pool wall can be reversed by flipping over of the bracket and reversal of the attachment clips.

* * * * *

UNITED STATES PATENT AND TRADEMARK OFFICE

CERTIFICATE OF CORRECTION

PATENT NO. : 4,068,327

DATED : January 17, 1978

INVENTOR(S) : Joseph Heinlein

It is certified that error appears in the above-identified patent and that said Letters Patent are hereby corrected as shown below:

Delete "And Method" from the title, so that the title will read:

--SWIMMING POOL SURFACE DEBRIS SKIMMER--.

Column 3, line 68 for "our" read --my--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*